US010753082B2

(12) United States Patent
Le

(10) Patent No.: US 10,753,082 B2
(45) Date of Patent: Aug. 25, 2020

(54) STRUCTURAL MEMBER JOINT AND STRUCTURE

(71) Applicant: NGUYEN CHI CO., LTD., Ho Chi Minh (VN)

(72) Inventor: Nguyen Thanh Le, Ho Chi Minh (VN)

(73) Assignee: NGUYEN CHI CO., LTD., Ho Chi Minh (VN)

( * ) Notice: Subject to any disclaimer, the term of this patent is extended or adjusted under 35 U.S.C. 154(b) by 0 days.

(21) Appl. No.: 16/307,123

(22) PCT Filed: Jun. 9, 2017

(86) PCT No.: PCT/JP2017/021531

§ 371 (c)(1),
(2) Date: Dec. 4, 2018

(87) PCT Pub. No.: WO2017/213263

PCT Pub. Date: Dec. 14, 2017

(65) Prior Publication Data

US 2019/0226201 A1 Jul. 25, 2019

(30) Foreign Application Priority Data

Jun. 10, 2016 (JP) ..... 2016-115874

(51) Int. Cl.
*E04H 12/00* (2006.01)
*E04B 1/58* (2006.01)
*E04B 1/24* (2006.01)

(52) U.S. Cl.
CPC ..... *E04B 1/5831* (2013.01); *E04B 1/2403* (2013.01); *E04B 1/58* (2013.01);
(Continued)

(58) Field of Classification Search
CPC ..... E04G 23/0218; F16B 7/00; F16B 7/0486; F16L 55/179; Y10T 403/48;
(Continued)

(56) References Cited

U.S. PATENT DOCUMENTS 2,839,320 A * 6/1958 Hill ..... E04G 7/02 403/172
2,923,542 A * 2/1960 Clark ..... B29C 65/562 269/296

(Continued)

FOREIGN PATENT DOCUMENTS

JP S61-197104 U 12/1986
JP H07-155227 A 6/1995
JP 3083965 U 2/2002

OTHER PUBLICATIONS

Aug. 22, 2017 International Search Report issued in International Patent Application No. PCT/JP2017/021531.

(Continued)

*Primary Examiner* — Chi Q Nguyen
(74) *Attorney, Agent, or Firm* — Oliff PLC

(57) ABSTRACT

This invention is to provide structural member joints capable of easily reinforcing connecting portions of structural members and a structure using the structural member joints. Each structural member joint includes three tubular joint members into which end portions of the structural members 7 can be inserted and fixed. The three tubular joint members are connected to each other at their proximal end portions and disposed at right angles to each other. Since the distal end portions of the joint members 2 arranged at right angles to each other are connected by the reinforcing members 6, it is possible to use the reinforcing members 6 to easily reinforce the connecting portions of the structural members 7.

20 Claims, 10 Drawing Sheets

(52) U.S. Cl.
CPC ..... *E04B 2001/2406* (2013.01); *E04B 2001/5856* (2013.01)

(58) Field of Classification Search
CPC ..... Y10T 403/7047; E04B 1/34331; E04B 1/34326; E04B 2001/0076; E04B 2001/2421; E04B 2001/2406; E04B 2001/2436; E04C 2003/046; E04C 2003/0465; E04C 2003/0469; E04C 2003/043
USPC ..... 403/171, 381, 345, 364, 286, 292, 294; 119/436, 519, 524; 182/186.7, 178.1, 182/178.2, 178.3, 178.5; 52/653.2, 81.3, 52/DIG. 10, 654.1, 653.1, 655.1
See application file for complete search history.

(56) References Cited

U.S. PATENT DOCUMENTS 4,703,769 A * 11/1987 Harrison, Jr. ..... A61H 3/00 135/67
5,230,197 A * 7/1993 Hart ..... E04B 1/19 52/638
5,605,410 A * 2/1997 Pantev ..... F16B 7/0486 403/174
5,678,706 A * 10/1997 Husak ..... A47B 47/005 211/189
6,702,391 B1 * 3/2004 Stipek ..... A47C 5/12 297/451.12
8,434,196 B1 * 5/2013 Murphey ..... H01Q 15/161 16/225
8,528,291 B2 * 9/2013 Allred, III ..... E04C 3/08 135/909
9,145,907 B2 * 9/2015 Liang ..... F16B 7/0486
2003/0101663 A1 * 6/2003 Boots ..... A01G 9/16 52/81.3
2003/0126828 A1 * 7/2003 Cook ..... E04G 23/0218 52/741.1
2010/0192506 A1 * 8/2010 Allred, III ..... E04C 3/08 52/655.1
2011/0179741 A1 * 7/2011 Yen ..... E04B 1/34326 52/653.1
2012/0180405 A1 * 7/2012 Drake ..... E04B 1/3211 52/81.3
2014/0331591 A1 * 11/2014 Ohlson ..... E04B 1/585 52/653.2
2016/0279865 A1 * 9/2016 Souza ..... F16L 55/168
2017/0362811 A1 * 12/2017 King, Jr. ..... B41J 2/1603

OTHER PUBLICATIONS

Aug. 22, 2017 Written Opinion issued in International Patent Application No. PCT/JP2017/021531.

* cited by examiner

[Fig 1]
(a)
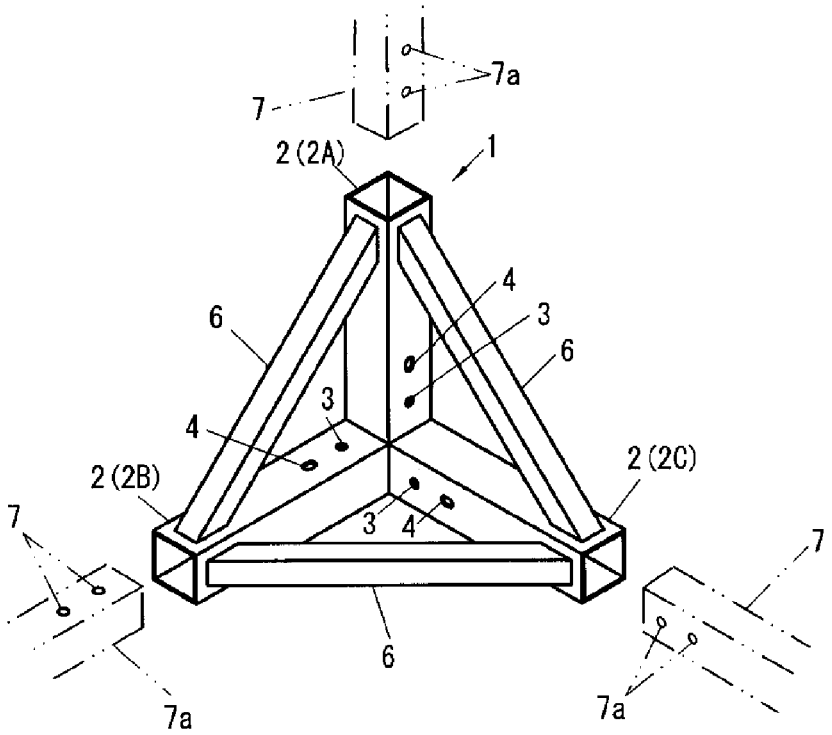
(b)
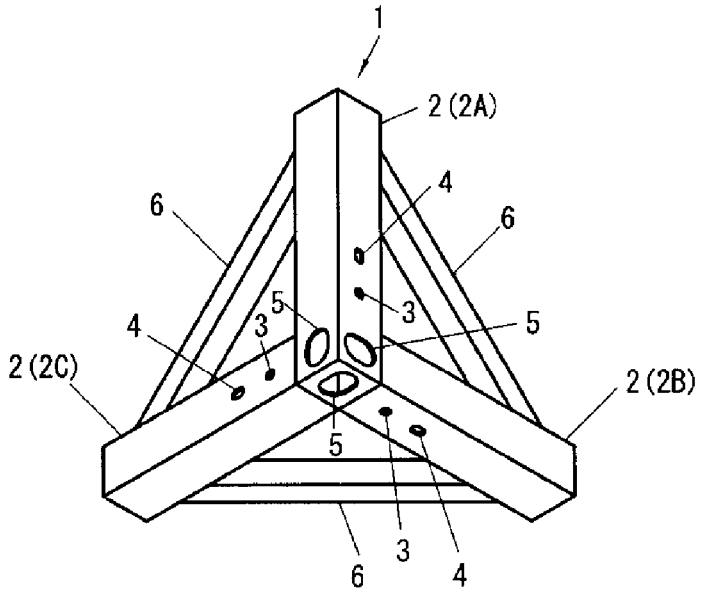

[Fig. 2]
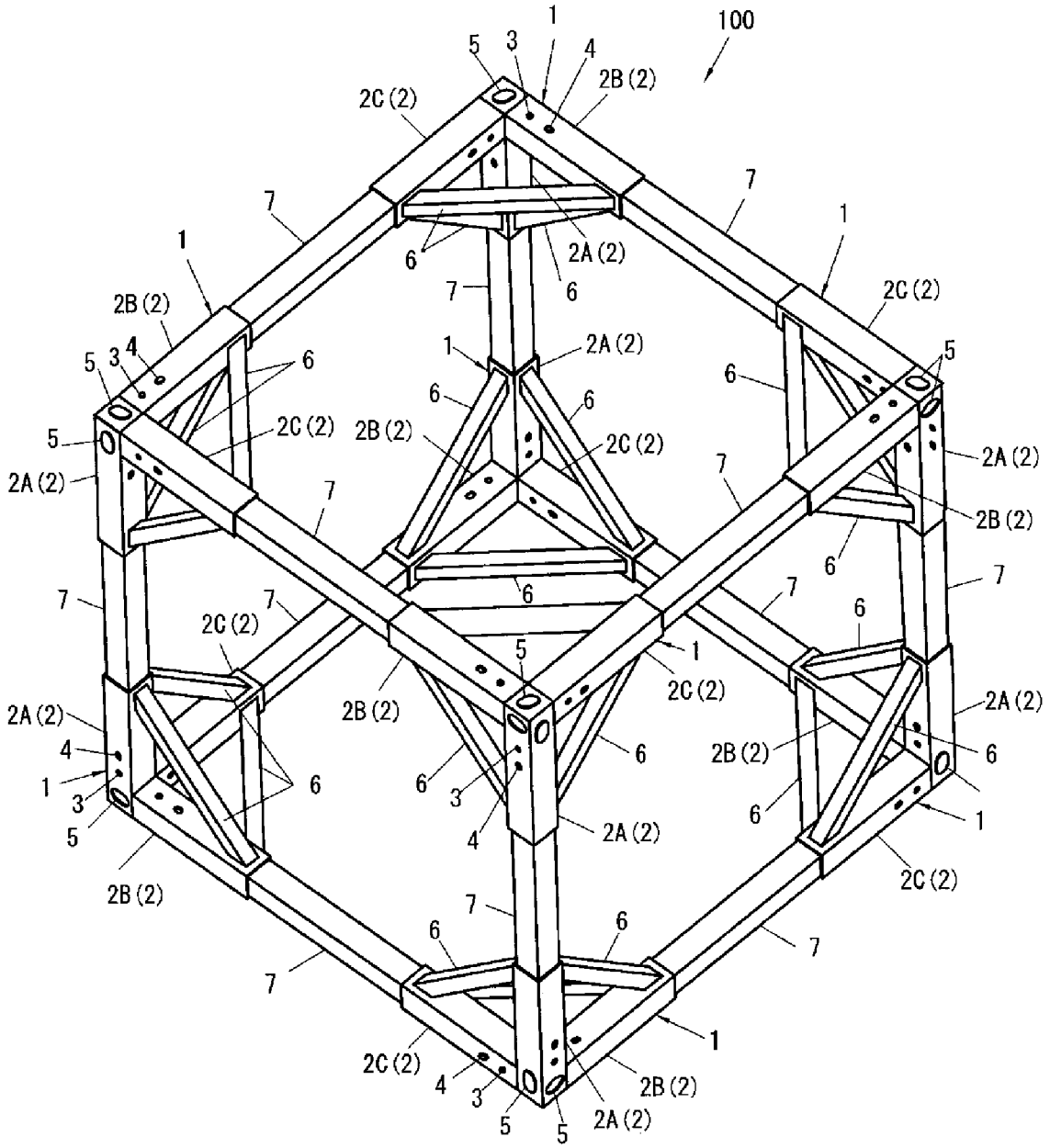

[Fig.3]
(a)
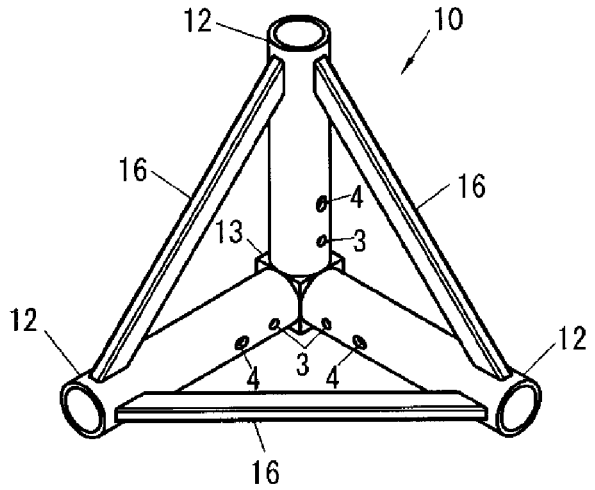
(b)
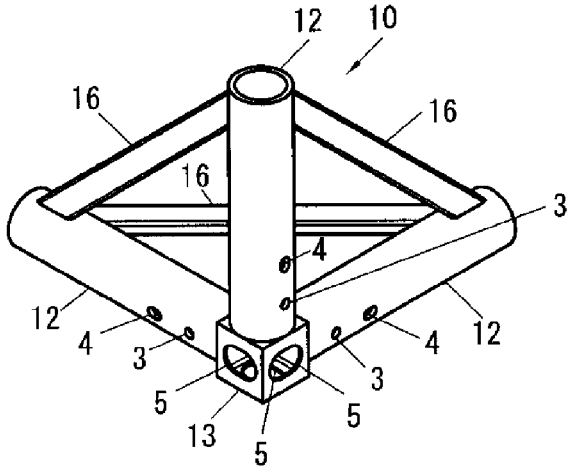

[Fig. 4]
(a)
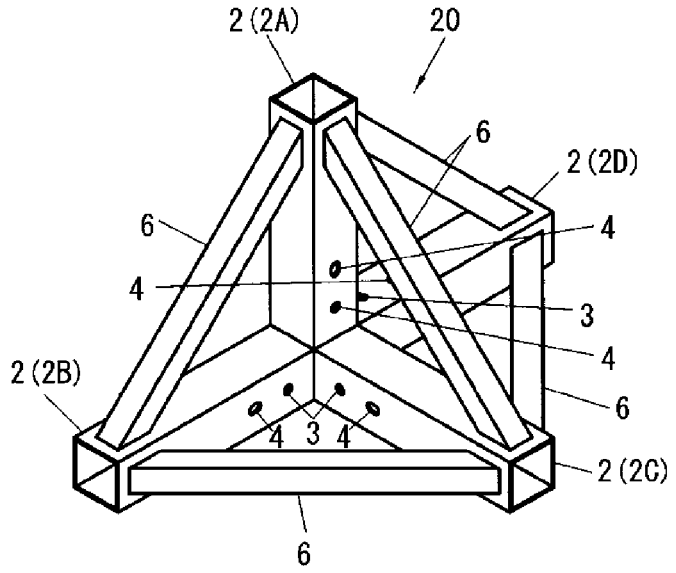
(b)
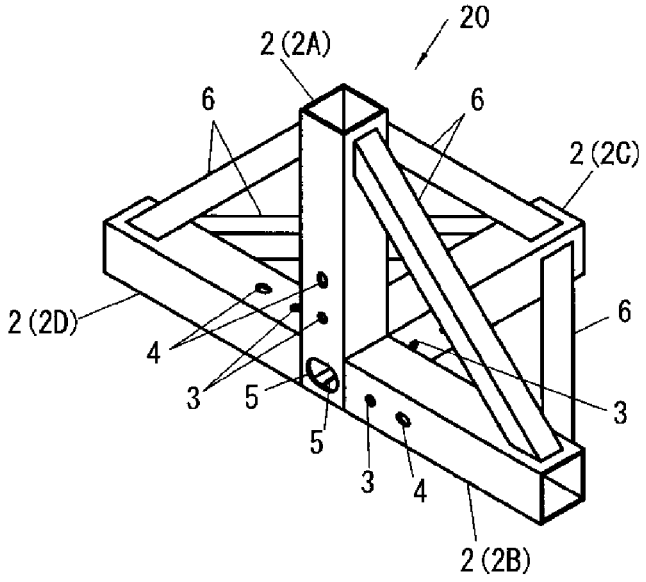

[Fig.5]
(a)
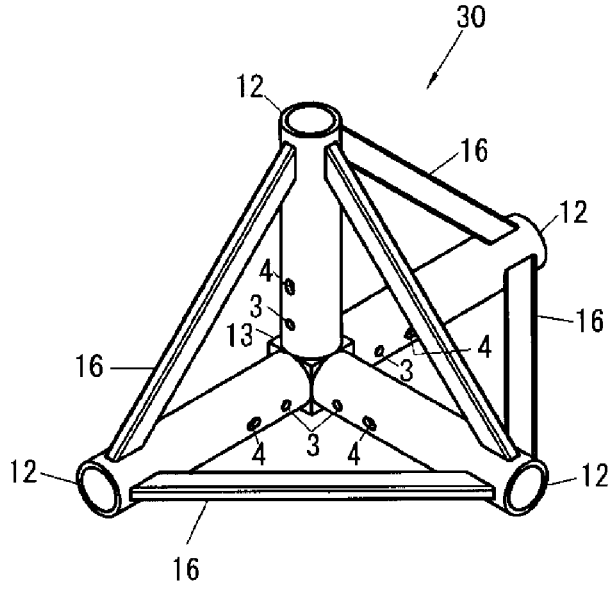
(b)
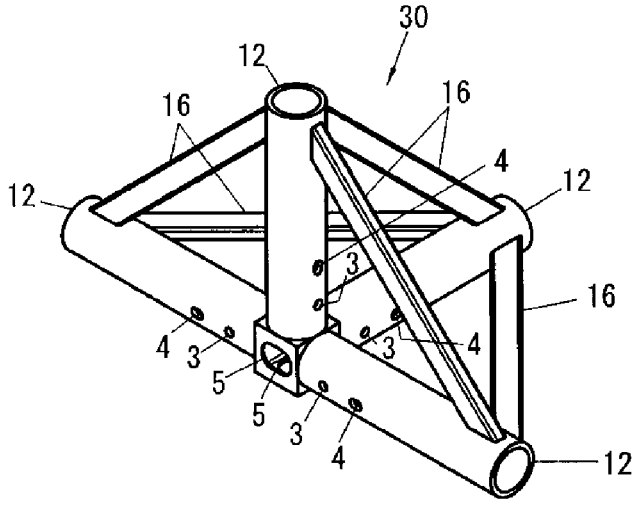

[Fig.6]
(a)
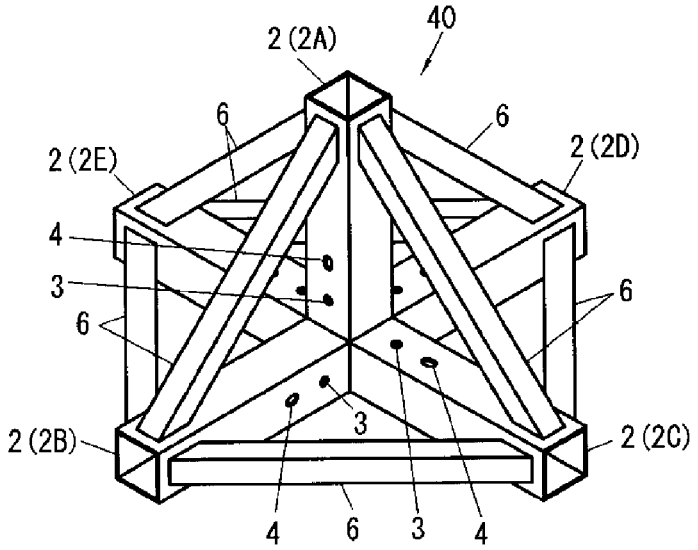
(b)
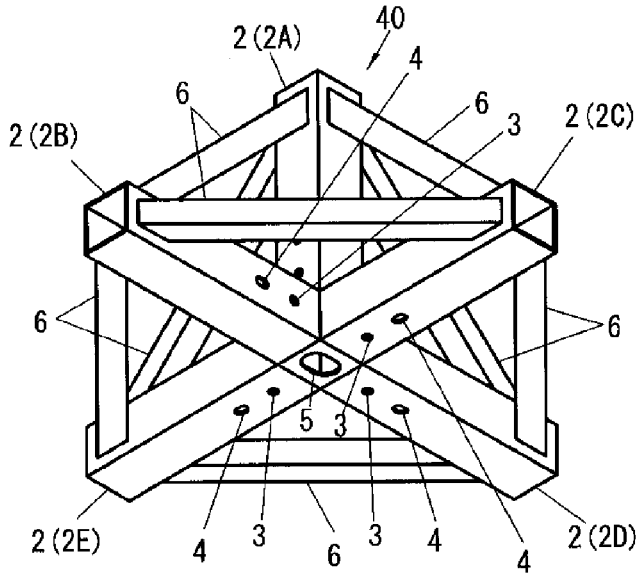

[Fig.7]
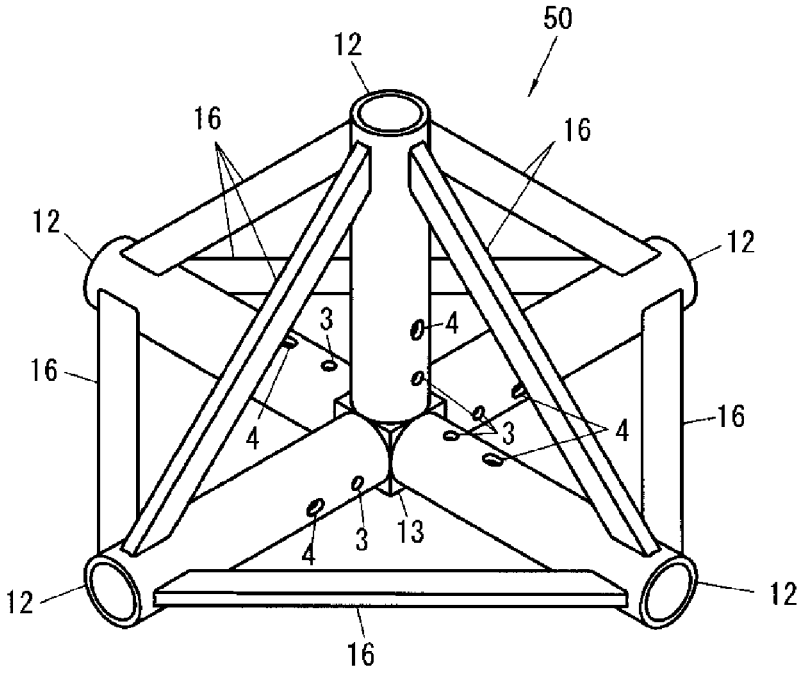
[Fig 8]
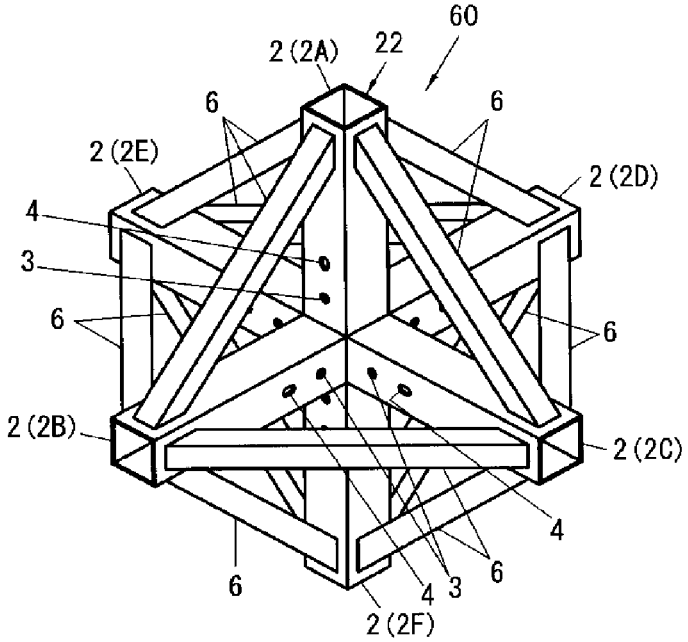

[Fig. 9]
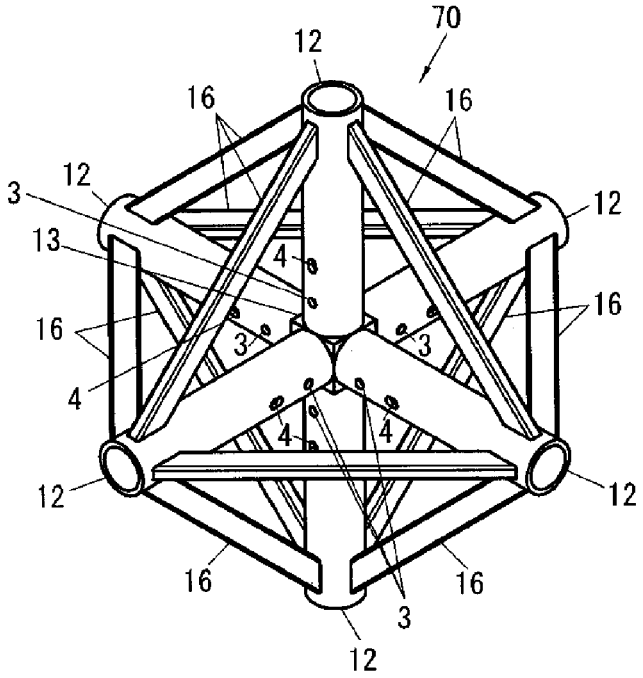

[Fig. 10]
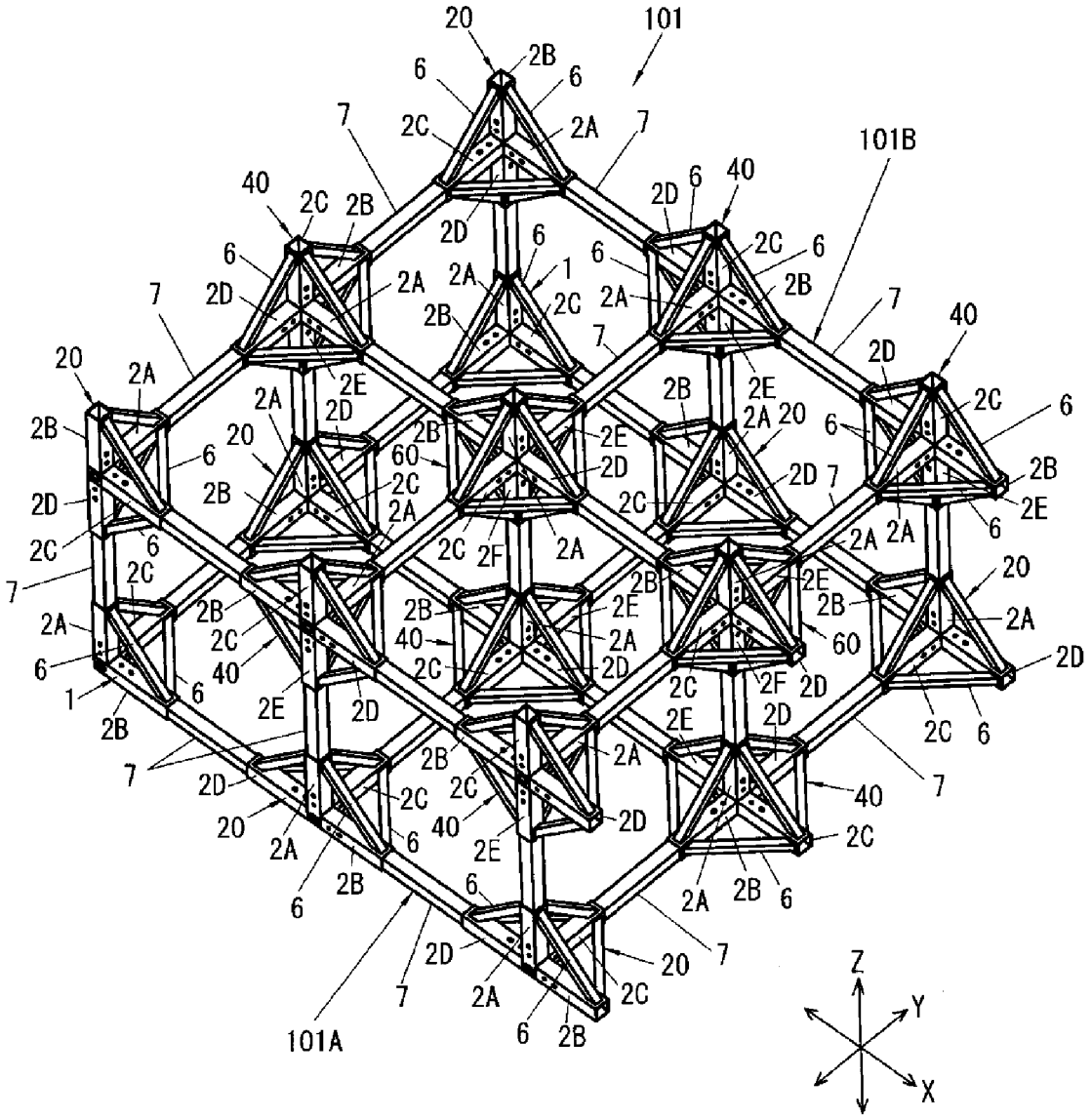

[Fig.11]
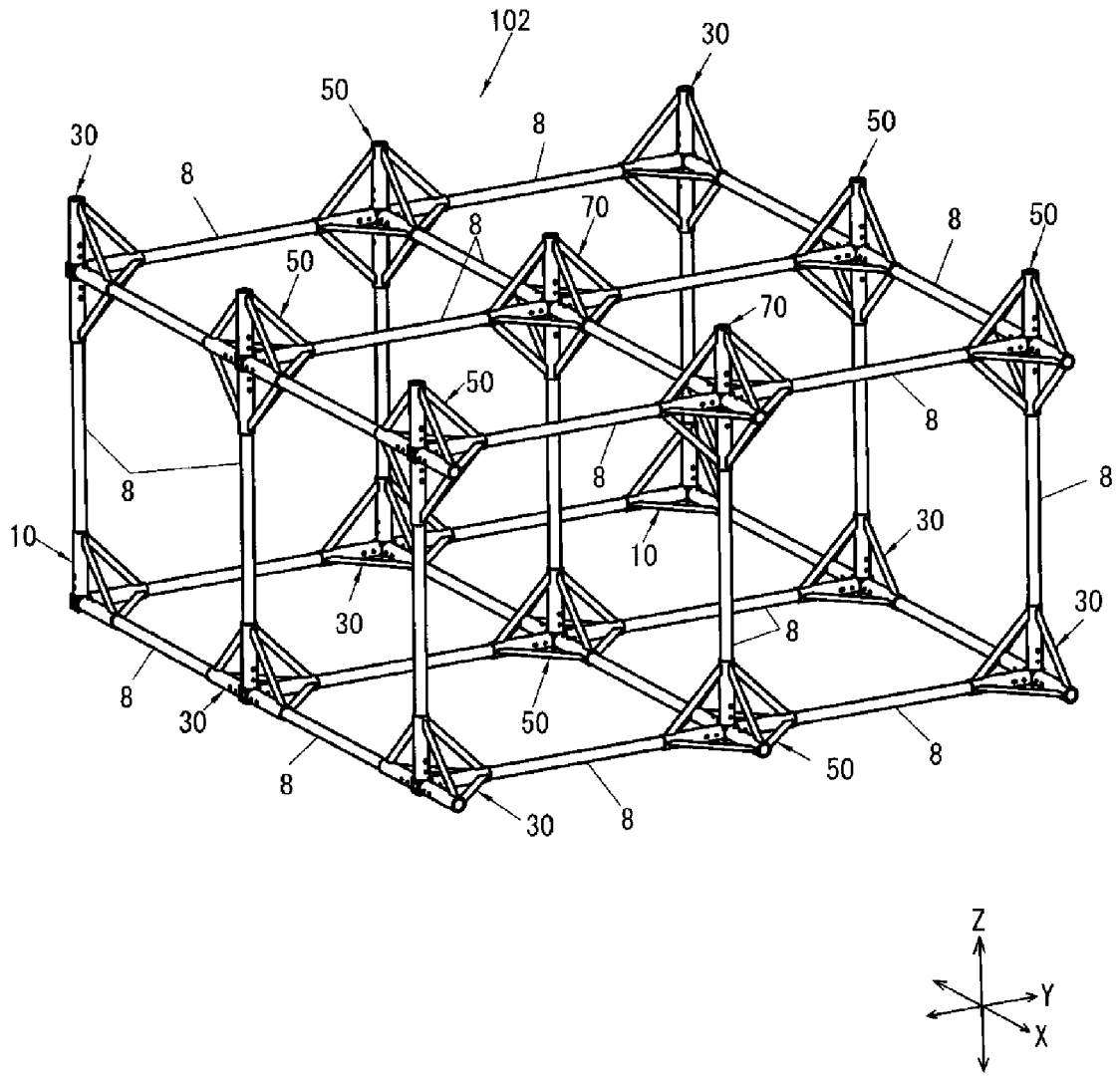

STRUCTURAL MEMBER JOINT AND STRUCTURE

TECHNICAL FIELD

The present invention relates to a structural member joint for connecting rod-like structural members, also relates to a structure.

BACKGROUND ART

When assembling a clothes hanger made of a rectangular parallelepiped framework formed by combining metal pipes, a three-way joint is disposed at each of eight corners of a rectangular parallelepiped framework, and a plurality of metal pipes are connected into a rectangular parallelepiped shape by virtue of the three-way joints, which can be seen, for example, in Patent Document 1.

CITATION LIST

Patent Literature

Patent Document 1: Japanese Unexamined Patent Application Publication No H07-155227

SUMMARY OF INVENTION

Technical Problem

However, in a rectangular parallelepiped framework assembled by using conventional three-way joints and metal pipes, since the metal pipes are only connected by the three-way joints at the eight corners thereof, the strength of connections between the metal pipes is not so high. As a result, when a force is applied to such a rectangular parallelepiped framework from the lateral direction, it is likely that an assembly of the metal pipes joined into a rectangular shape constituting one surface of the rectangular parallelepiped framework may be deformed into a parallelogram shape.

As a result, for example, if merely assembling rod-like structural members into a rectangular parallelepiped shape using three-way joints, there is a possibility that the strength of connecting portions (corner portions) will be insufficient, rendering it difficult to use such an assembly as a rectangular parallelepiped body or the like. Consequently, it becomes necessary to attach a reinforcing member to each connecting portion of the structure, hence undesirably increasing working time and labor.

The present invention has been accomplished in view of the above circumstances, and it is an object of the present invention to provide a structural member joint which can easily reinforce connecting portions of structural members, and to provide a structure using the structural member joint.

Solution to Problem

In order to achieve the above object of the present invention, there is provided a first structural member joint for connecting rod-like structural members, wherein

- the structural member joint includes three tubular joint members into which end portions of the structural members can be inserted and fixed;
- the three tubular joint members are connected to each other at their proximal end portions and disposed at right angles to each other;

- the tubular joint members disposed at right angles to each other are connected by reinforcing members.

A second structural member joint of the present invention is also provided for connecting rod-like structural members, wherein

- the structural member joint includes four tubular joint members into which end portions of the structural members can be inserted and fixed;
- the four tubular joint members are connected to each other at their proximal end portions;
- three of the four tubular joint members are disposed into T-shaped formation, the remaining one is disposed at right angle with other three tubular joint members;
- the tubular joint members disposed at right angles to each other are connected by reinforcing members.

A third structural member joint of the present invention is also provided for connecting rod-like structural members, wherein

- the structural member joint includes five tubular joint members into which end portions of the structural members can be inserted and fixed;
- the five tubular joint members are connected to each other at their proximal end portions;
- four of the five tubular joint members are disposed into cross-shaped formation, the remaining one is disposed at right angle with other four tubular joint members;
- the tubular joint members disposed at right angles to each other are connected by reinforcing members.

A fourth structural member joint of the present invention is also provided for connecting rod-like structural members, wherein

- the structural member joint includes six tubular joint members into which end portions of the structural members can be inserted and fixed;
- the six tubular joint members are connected to each other at their proximal end portions;
- four of the six joint members are disposed into cross-shaped formation, the remaining two are disposed into one straight line and disposed at right angle with other four tubular joint;
- the joint members disposed at right angles to each other are connected by reinforcing members.

Here, as the tubular joint member, it is possible to use joint members having regular square tubular shape, which is shown for example in FIGS. 1, 4, 6, 8 and the like, and cylindrical joint members and the like which are shown in FIGS. 3, 5, 7, 9. However, joint members are not limited to those shown in these figures, and it is also possible to use a polygonal tubular joint member, an elliptical cylindrical joint member, an oval cylindrical joint member, or the like. In short, any tubular joint members can be used, provided that end portions of the rod-like structural members to be connected can be inserted into these joint members.

In addition, the proximal end portions of the joint members are firmly coupled to each other, so that an angle formed by the joint members arranged at right angles to each other can be accurately maintained at a right angle (90 degrees).

As the reinforcing member, it is possible to use, for example, a reinforcing member having a quadrangular prism shape or a square cylindrical shape, or a reinforcing member having a columnar shape or a cylindrical shape. However, reinforcing members are not limited to those shown in the figures, and it is also possible to use a polygonal columnar reinforcing member, a polygonal cylindrical reinforcing member, an elliptical columnar reinforcing member, an elliptical cylindrical reinforcing member, an oval columnar reinforcing member, or an oval cylindrical reinforcing member.

Further, the reinforcing member are not limited to a columnar shape or a cylindrical shape or the like, but may be, for example, a plate shape. At this time, one side of the plate-like reinforcing member may be fixed to one of the joint members disposed at right angles to each other, and the other side of the reinforcing member may be fixed to the other of the joint members arranged at right angles to each other.

Regarding the structural member joint formed according to the present invention, since the joint members disposed at right angles to each other are connected by the reinforcing members, it is possible to use the reinforcing members to easily reinforce the connecting portions of the structural members connected by the structural member joints.

A structure assembled by using a plurality of rod-like structural members, wherein a plurality of structural member joints are selectively disposed at connecting portions of the structural members, and a plurality of the structural members are connected by these structural member joints.

In the structure formed according to the present invention, since the distal end portions of the joint members arranged at right angles to each other are connected by the reinforcing members, it is possible to use the reinforcing members to easily reinforce the connecting portions of the structural members connected by the structural member joints.

In the above configuration of the present invention, at least a part of the structural member joints disposed on the outside of the structure is allowed to have joint members to which no structural members are connected.

According to the above-described configuration, since at least a part of the structural member joints arranged on the outer side of the structure have joint members not connected with structural members, it is possible to infinitely expand the structure in the up-down direction and the left-right direction by connecting other structural members to the joint members and connecting other structural member joints to the structural members.

Effect of the Invention

Using the present invention, it is possible to employ the reinforcing members to easily reinforce the connecting portions of the structural members connected by the structural member joints.

BRIEF DESCRIPTION OF DRAWINGS

FIG. 1 shows a structural member joint formed according to a first embodiment of the present invention, in which (a) is a perspective view seen obliquely from above and (b) is a perspective view seen obliquely from below.

FIG. 2 is a perspective view showing a structure formed according to an embodiment of the present invention.

FIG. 3 is a perspective view of a structural member joint formed according to a second embodiment of the present invention, in which (a) is a front view seen from the front side, and (b) is a perspective view seen from the back side.

FIG. 4 shows a structural member joint formed according to a third embodiment of the present invention, in which (a) is a perspective view seen from the front side, and (b) is a perspective view seen from the back side.

FIG. 5 shows a structural member joint formed according to a fourth embodiment of the present invention, in which (a) is a perspective view seen from the front side, and (b) is a perspective view seen from the back side.

FIG. 6 shows a structural member joint formed according to a fifth embodiment of the present invention, in which (a) is a perspective view seen obliquely from above, and (b) is a perspective view seen obliquely from below.

FIG. 7 is a perspective view showing a structural member joint formed according to a sixth embodiment of the present invention.

FIG. 8 is a perspective view showing a structural member joint formed according to a seventh embodiment of the present invention.

FIG. 9 is a perspective view showing a structural member joint formed according to an eighth embodiment of the present invention.

FIG. 10 is a perspective view showing a structure formed according to another embodiment of the present invention.

FIG. 11 is a perspective view showing a structure formed according to a further embodiment of the present invention.

DESCRIPTION OF EMBODIMENTS

Hereinafter, description will be given to a structural member joint and a structure formed according to the present invention, with reference to the accompanying drawings.

First Embodiment

FIG. 1 is a perspective view showing a structural member joint formed according to a first embodiment, in which (a) is a perspective view showing the front side as seen obliquely from above, and (b) is a perspective view showing the back side as seen obliquely from below.

As shown in FIG. 1, the structural member joint 1 is used for connecting rod-like structural members 1, and includes three joint members 2 into which end portions of structural members 7 can be inserted and fixed. Each joint member 2 is formed into a square tetragonal shape, and their proximal end portions are coupled to each other by welding, adhesion, or the like. Specifically, the proximal end portion of a joint member 2 (2B) extending in the horizontal direction is coupled to the lower end portion on one of two mutually orthogonal side faces of the joint member 2 (2A) extending vertically, while the proximal end portion of another joint member 2 (2C) extending in the horizontal direction is coupled to the other of the two mutually orthogonal side faces. Further, the three joint members 2 are disposed at right angles to each other.

Here, although the joint members 2B, 2C are set to have the same length, and the joint member 2A is set to have a length (that is in fact a height extending from the upper surfaces of the joint members 2B, 2C) which is the same as the joint members 2B, 2C, the lengths of the joint members 2A-2C are allowed to be set appropriately as needed.

A circular hole 3 and an elliptical hole 4 are formed in the proximal end portion of each joint member 2 on opposite side walls thereof, space apart from each other in the axial direction of joint member 2. In detail, the hole 3 is formed to face an opposing side wall, and the hole 4 is also formed to face the opposing side wall.

The holes 3, 4 formed on the upper surface and the lower surface of the joint member 2B may be formed on the side walls on both side surfaces, and the holes 3, 4 formed on the side walls on both side surfaces of the joint member 2C may be formed on the upper and lower side walls. On the other hand, the holes 3, 4 formed on one pair of mutually opposed side walls of the joint member 2A may be formed on the other pair of the mutually opposed side walls.

Elliptical holes 5 which are larger than the holes 4, are formed in the lower end portion of the joint member 2A, on the side walls disposed at the lower end and at right angles to each other.

Also, the end portions of the joint members 2 disposed at right angles to each other are connected by reinforcing members 6.

That is, each reinforcing member 6 is formed into a regular tetragonal cylindrical shape having a smaller cross-section than joint member 2, and both end portions thereof are inclined surfaces inclined at an angle of 45° with respect to side surfaces of the joint members 2. In detail, each reinforcing member 6 is arranged between the distal end portions of the joint members 2, 2 disposed at right angle to each other, and its end portions are joined to the side walls of the joint members 2, 2 by welding, adhesion or the like. Further, each reinforcing member 6 is inclined at an angle of 45° with respect to the joint members 2, 2 being connected therewith.

FIG. 2 is a perspective view of a structure 100 assembled by combining a plurality of rod-like structural members 7 using such a structural member joint 1 described above.

The structure 100 is assembled by disposing a structural member joint 1 at each of the eight corners (connecting portions) for forming the structure, and connecting a plurality of structural members 7 into a rectangular parallelepiped shape using these structural member joints 1.

Namely, at first, the structural member joints 1 are disposed in a manner such that each joint member 2A is arranged in up-down direction, with an end portion of one joint member 2A being positioned as an upper side on the upper surface side of the structure 100, while an end portion of another joint member 2A being poisoned as a lower side on the lower surface side of the structure 100. Here, each structural member joint 1 is located at each of the eight corners (connecting portions) of the structure 100.

Subsequently, the structure 100 is assembled into a cubic box shape by connecting twelve structural members 7 using structural member joints 1.

Each of the twelve structural members 7 is formed into a regular square tubular shape, and has the same length as each other. In addition, each structural member 7 has a cross-sectional shape that can be inserted into a joint member 2 of structural member joint 1, so that both end portions of the structural member 7 can be inserted into the joint members 2, 2 of the adjacent structural member joints 1, 1 without forming any gaps. Also, as shown in FIG. 1(*a*), two circular holes 7*a*, 7*a* are formed at both end portions of each structural member 7 on side walls opposed to each other, the two holes being separated from each other in the longitudinal direction of the structural member 7. In this way, the holes 7*a*, 7*a* are opposed to the holes 3, 4 of joint member 2 in a state where the end portions of the structural member 7 are inserted into the joint members 2, 2.

Then, bolts (not shown) are inserted into the holes 3, 7*a* and the holes 4, 7*a*, respectively, and tightened together by screwing nuts thereon, so that the structural member 7 can be fixed to the joint members 2, 2 without a possibility of coming off.

In this way, regarding the assembled structure 100, the distal end portions of the joint members 2, 2 disposed at right angles to each other in the structural member joint 1 arranged at connection portion between the structural members 7 are connected by virtue of the rod-like reinforcing members 6. Therefore, it is possible to use the reinforcing members 6 to easily reinforce the connecting portions of the structural members 7 connected by the structural member joints 1.

Further, by changing the length dimension of each structural member 7, it is possible to easily assemble a rectangular parallelepiped box-shaped structure.

Furthermore, when the structure 100 is installed on a foundation made of reinforced concrete, for example, the upper end portions of anchor bolts protruding from the foundation are inserted into the holes 5 formed on the bottom walls (lower end walls) of the joint members 2A. Meanwhile, nuts are inserted into the joint members 2A from the holes 5 formed on the side walls of the joint members 2A, and bolts are screwed into the nuts to tight the same. In this way, it is possible to easily connect and fix the structure 100 to the foundation.

Further, the structure 100 is not limited to the foundation and the like, and may be fixed on the floor of a building, the floor of a truck bed or the like in the same manner as described above.

Moreover, the structure 100 can be fixed onto the wall of a constructed building or the like by utilizing the holes 5 formed on the side walls of the joint members 2 of the structural member joints 1. At this time, fixing bolts may be projected from the wall of building, and the fixing bolts are inserted into the holes 5 and tightened with nuts.

Second Embodiment

FIG. 3 shows a structural member joint formed according to the second embodiment, in which (a) is a perspective view seen from the front side, and (b) is a perspective view seen from the back side.

A main difference between the structural member joint 10 of the present embodiment and the structural member joint 1 of the first embodiment is in the joint member configuration. Therefore, the following description will be given to this point, while the same reference numerals are given to the same configurations as those of the first embodiment, and the explanation thereof will be omitted or simplified.

As shown in FIG. 3, three joint members 12 of the structural member joint 10 are each formed into a cylindrical shape, with the proximal end portions of these joint members 12 being coupled to each other using a fixing member 13. Further, although the three joint members 12 are set to have the same length, the lengths of the joint members 12 may be appropriately set as needed.

The fixing member 13 is formed into a cubic box shape, and elliptical holes 5 are formed on wall portions other than the wall portions to which the joint members 12 are fixed. Namely, the holes 5 are respectively formed on two side walls and the bottom wall facing outside. The length of one side of the cubic fixing member 13 is set to be substantially equal to or slightly shorter than the diameter of the joint member 12.

Then, the proximal end portions of the joint members 12 are joined to the two side walls and the upper wall facing the inside of the structural member joint 10, for example, by welding, adhesion, or the like. In addition, these three joint members 12 are arranged at right angles to each other.

Further, on the cylindrical outer peripheral wall of each joint member 12, circular holes 3 and elliptical holes 4 are formed spaced apart in the axial direction of the joint member 12, with two holes 3, 3 facing each other in the radial direction across the cylindrical joint member 12, and two holes 4, 4 facing each other also in the radial direction across the cylindrical joint member 12.

The positions of the holes 3, 4 in the circumferential direction of the outer peripheral wall of the joint member 12 may be appropriately set as needed.

Further, the distal end portions of the joint members 12 disposed at right angles to each other are connected by the reinforcing members 16.

Namely, each reinforcing member 16 is formed into a band plate shape having a smaller cross-sectional shape than the joint member 12, and both end portions thereof are inclined surfaces inclined at an angle of 45° with respect to one side surface of joint member 12. The reinforcing member 16 is disposed between the distal end portions of the joint members 12, 12 arranged at right angles to each other, and its end portions are joined and fixed to the side walls (outer peripheral walls) of the joint members 12 by welding, adhesion or the like. The reinforcing member 16 is inclined at an angle of 45° with respect to the joint members 12 already joined and fixed.

Although not shown, using the above-described structural member joints 10 and a plurality of structural members, it is possible to assemble a structure similar to the structure 100 shown in FIG. 2. At this time, each structural member has a cylindrical or columnar shape and has a cross-sectional shape that can be inserted into joint member 12. As a result, both end portions of each structural member can be inserted into the adjacent joint members 12, 12 of the structural member joints 10, without forming any gaps.

Then, by inserting bolts into the holes 3, 4 of the structural member joint 10 and the holes formed in the structural member and fastening them with nuts, each structural member can be fixed to the joint members 12 while being prevented from coming off.

In this way, in an assembled structure, as in the first embodiment, the joint members 12 arranged at right angles to each other in the structural member joint 10 arranged at the connecting portion between the structural members are connected by the rod-like reinforcing members 16, thus making it possible to use the reinforcing members 16 to easily reinforce the connecting portions of the structural materials which are connected by the structural member joints 10.

Further, by changing the length of the structural members, it is possible to easily assemble a rectangular parallelepiped box-shaped structure.

Moreover, it is possible to easily fix the structure on the floor of a building, the floor of a truck bed or the like in the same manner as in the first embodiment.

Third Embodiment

FIG. 4 shows a structural member joint formed according to a third embodiment, in which (a) is a perspective view seen from the oblique front side, (b) is a perspective view seen from an oblique back side.

A main difference between the structural member joint 20 of the present embodiment and the structural member joint 1 of the first embodiment is the number of the joint members 2. Thus, the following description will be given to this difference, using the same reference numerals to represent the same configuration as the first embodiment, with the description thereof being omitted or simplified.

As shown in FIG. A, the structural member joint 20 of the present embodiment is provided with four regular square tubular joint members 2. The proximal end portions of these joint members 2 are coupled to each other by welding, adhesion, or the like.

Also, among the four joint members 2A-2D, three joint members 2B-2D are arranged into T-shape, and the remaining one joint member 2A is disposed at right angle with the three joint members 2B-2D. Specifically, the proximal end portion of the joint member 2 (2B) extending in the horizontal direction is coupled orthogonally to the lower end portion of one of two mutually orthogonal side faces of the vertically extending joint member 2 (2A), the proximal end portion of other joint member 2 (2C) extending in the horizontal direction is coupled to the lower end portion of the other of the two mutually orthogonal side faces of the vertically extending joint member 2 (2A), and the further joint member 2 (2D) extending in the horizontal direction is coupled to the lower end portion on a further side (orthogonal to the aforementioned other of the two mutually orthogonal side faces) of the joint member 2A. That is, the number of the joint members 2 is one more than the structural member joint 1 in the first embodiment.

Here, although the joint members 2B-2D are set to have the same length, and the joint member 2A is set to have a length (that is in fact a height extending from the upper surfaces of the joint members 2B-2D) which is the same as the joint members 2B-2D, the lengths of 2A-2D may be set appropriately as needed.

The distal end portions of the joint members 2 arranged at right angles to each other are connected by the reinforcing members 6 as in the first embodiment. In the first embodiment, the total number of the reinforcing members 6 is three, but in the present embodiment there are five reinforcing members 6 in total.

Further, elliptical holes 5 are formed respectively on the bottom wall (lower end wall), and on the side wall on the back side at the lower end portion of the joint member 2A.

Also, in this embodiment, since the distal end portions of the joint members 2 arranged at right angles to each other are connected by the rod-like reinforcing members 6, it is possible to use the reinforcing members 6 to easily reinforce the connecting portions of the structural members connected by the structural member joints 20.

Fourth Embodiment

FIG. 5 shows a structural member joint formed according to a fourth embodiment, in which (a) is a perspective view seen from an oblique front side, and (b) is a perspective view seen from an oblique back side.

A main difference between the structural member joint 30 of the present embodiment and the structural member joint 20 of the third embodiment is the joint member configuration. Therefore, the following description will be given to this difference, using the same reference numerals to represent the same configuration as the third embodiment, with the description thereof being omitted or simplified.

As shown in FIG. 5, the four joint members 12 of the structural member joint 30 are each formed into a cylindrical shape, and the proximal end portions of these joint members 12 are coupled to each other via a fixing member 13. Further, although the four joint members 12 are set to have the same length, the lengths of the joint members 12 may be appropriately set as needed.

The fixing member 13 is formed into a cubic box shape, and elliptical holes 5 are formed on wall portions other than the wall portions to which the joint members 12 are fixed. Namely, holes 5 are formed on the side wall on the back side of the fixing member 13 and on the bottom wall thereof.

Further, the proximal end portions of the joint members 12 are fixed to the three side walls and the upper wall of the fixing member 13, for example, by welding, adhesion, or the like.

Moreover, on the cylindrical outer wall (outer peripheral wall) of each joint member 12, circular holes 3 and elliptical holes 4 are formed spaced apart in the axial direction of the joint member 12, with two holes 3, 3 facing each other in the radial direction across the cylindrical joint member 12, and two holes 4, 4 facing each other also in the radial direction across the cylindrical joint member 12.

In addition, the distal end portions of the joint members 12 disposed at right angles to each other are connected by the reinforcing members 16.

Also, in the present embodiment, since the distal end portions of the joint members 12 disposed at right angles to each other are connected by the rod-like reinforcing members 16, it is possible to use the reinforcing members 16 to easily reinforce the connecting portions of the structural members connected by the structural member joints 30.

Fifth Embodiment

FIG. 6 shows a structural member joint formed according to a fifth embodiment, in which (a) is a perspective view seen obliquely from above, (b) is a perspective view seen obliquely from below.

A main difference between the structural member joint 40 of the present embodiment and the structural member joint 20 of the third embodiment is the number of joint members 2. Therefore, the following description will be given to this difference, using the same reference numerals to represent the same configuration as the third embodiment, with the description thereof being omitted or simplified.

As shown in FIG. 6, the structural member joint 40 of the present embodiment has five regular square tubular joint members 2. The proximal end portions of these joint members 2 are coupled to each other by welding, adhesion, or the like.

Four joint members 2B-2E among the five joint members 2A-2E are arranged into a cross shape and the remaining one joint member 2A is arranged to be perpendicular to the four joint members 2B-2E.

Specifically, the proximal end portion of the joint member 2 (2B) extending in the horizontal direction is coupled orthogonally to the lower end portion on one of the two mutually orthogonal side faces of the vertically extending joint member 2 (2A), the proximal end portion of other joint member 2 (2C) extending in the horizontal direction is coupled to the lower end portion on the other of two mutually orthogonal side faces of the vertically extending joint member 2 (2A), and the further joint member 2 (2D) extending in the horizontal direction is coupled to the lower end portion on a further side (orthogonal to the aforementioned other of the two mutually orthogonal side faces) of the joint member 2A. In addition, a still further joint member 2 (2E) is joined to the lower end portion on side surface disposed at the right angle to the aforementioned one of two mutually orthogonal side faces. That is, the number of the joint members 2 is one more than the structural member joint 20 in the third embodiment.

Although the joint members 2B-2E are set to have the same length and the joint member 2A is set to have a length (that is in fact a height extending from the upper surfaces of the joint members 2B-2E) which is the same as the joint members 2B-2E, the lengths of 2A-2E may be set appropriately as needed.

The distal end portions of the joint members 2 arranged at right angles to each other are connected by the reinforcing members 6 in the same manner as in the third embodiment. In the third embodiment, the total number of the reinforcing members 6 is five, but in the present embodiment there are eight reinforcing members 6 in total.

Further, an elliptical hole 5 is formed on the bottom wall (lower end wall) of the lower end portion of the joint member 2A.

Also, in the present embodiment, since the distal end portions of the joint members 2 arranged at right angles to each other are connected by the rod-like reinforcing members 6, it is possible to use the reinforcing members 6 to easily reinforce the connecting portions of the structural members connected by the structural member joints 40.

Sixth Embodiment

FIG. 7 is a perspective view showing a structural member joint formed according to a sixth embodiment.

A main difference between a structural member joint 50 of the present embodiment and the structural member joint 40 in the fifth embodiment is the joint member configuration. Therefore, the following description will be given to this difference, using the same reference numerals to represent the same configuration as the fifth embodiment, with the description thereof being omitted or simplified.

As shown in FIG. 7, five joint members 12 of the structural member joint 50 are each formed into a cylindrical shape, and the proximal end portions of these joint members 12 are coupled to each other using a fixing member 13. Although the five joint members 12 are set to have the same length, the lengths of the joint members 12 may be appropriately set as needed.

Here, the fixing member 13 is formed into a cubic box shape, and an elliptical hole (not shown) is formed on a wall portion other than wall portions to which the joint members 12 are fixed, i.e., bottom wall (lower end wall) of the fixing member 13. This hole has the same structure as the hole 5 shown in FIG. 6(*b*).

Further, the proximal end portions of the joint members 12 are fixed to the four side walls and the upper wall of the fixing member 13 by welding, adhesion, or the like.

Moreover, on the cylindrical outer wall (outer peripheral wall) of each joint member 12, circular holes 3 and elliptical holes 4 are formed spaced apart in the axial direction of the joint member 12, with two holes 3, 3 facing each other in the radial direction across the cylindrical joint member 12, and two holes 4, 4 facing each other also in the radial direction across the cylindrical joint member 12.

In addition, the distal end portions of the joint members 12 disposed at right angles to each other are connected by reinforcing members 16.

Also, in the present embodiment, since the distal end portions of the joint members 12 disposed at right angles to each other are connected by the rod-like reinforcing members 16, it is possible to use the reinforcing members 16 to easily reinforce the connecting portions of the structural members connected by the structural member joints 50.

Seventh Embodiment

FIG. 8 is a perspective view showing a structural member joint formed according to a seventh embodiment.

A main difference between a structural member joint 60 of the present embodiment and the structural member joint 40 in the fifth embodiment is the number of the joint members 2. Therefore, the following description will be given to this difference, using the same reference numerals to represent the same configuration as the fifth embodiment, with the description thereof being omitted or simplified.

As shown in FIG. 3, the structural member joint 60 of the present embodiment has six regular square tubular joint members 2. The proximal end portions of these joint members 2 are coupled to each other by welding, adhesion, or the like.

Further, four joint members 2B-2E among the six joint members 2A-2F are arranged into a cross shape and the remaining two joint members 2A, 2F are arranged into a straight line at the right angle with the four joint members 2B-2E.

In the present embodiment, although the joint member 2 (2A) and the joint member 2 (2F) extending in the vertical direction apparently constitute two joint members 2, this configuration is in fact formed by an elongated single joint member 22 extending in the up-down direction and having a length longer than the joint member 2, with the upper portion of the joint member 22 serving as the joint member 2A and the Lower portion thereof serving as the joint member 2F.

The proximal end portions of the four joint members 2 (2B)-2 (2 E) extending in the horizontal direction are fixed to the four side surfaces of the central portion of the joint member 22 by welding, adhesion, or the like. In the structural member joint 60 of the present embodiment, the number of the joint members 2 is one more than the structural member joint 40 in the fifth embodiment.

Here, the joint members 2B-2E are set to have the same length, the joint member 2A is set to have a length (that is in fact a height extending from the upper surfaces of the joint members 2B-2E) which is the same as the joint members 2B-2E, and the joint member 2F is also set to have a length (that is in fact a height extending from the lower surfaces of the joint members 2B-2E) which is the same as the joint members 2B-2E. On the other hand, the lengths of the joint members 2A-2F can be set appropriately as needed.

The distal end portions of the joint members 2 arranged at right angles to each other are connected by reinforcing members 6 in the same manner as in the fifth embodiment. In the fifth embodiment, the total number of the reinforcing members 6 is eight, but in the present embodiment there are twelve reinforcing members 6 in total.

Also, in the present embodiment, since the distal end portions of the joint members 2 disposed at right angles to each other are connected by the rod-like reinforcing members 6, it is possible to use the reinforcing members 6 to easily reinforce the connecting portions of the structural members connected by the structural member joints 60.

Eighth Embodiment

FIG. 9 is a perspective view showing a structural member joint formed according to an eighth embodiment.

A main difference between a structural member joint 70 of the present embodiment and the structural member joint 60 of the seventh embodiment is the joint member configuration. Therefore, the following description will be given to this difference, using the same reference numerals to represent the same configuration as the seventh embodiment, with the description thereof being omitted or simplified.

As shown in FIG. 9, six joint members 12 of the structural member joint 70 are each formed into a cylindrical shape, and the proximal end portions of these joint members 12 are coupled to each other using a fixing member 13. Although the six joint members 12 are set to have the same length, the lengths of the joint members 12 may be appropriately set as needed.

The fixing member 13 is formed into a cubic box shape, and the proximal end portions of the joint members 12 are respectively fixed to the four side walls of the fixing member 13, the upper surface wall, and the lower service wall of the fixing member 13 by welding, adhesion, or the like. Further, on the cylindrical outer wall (outer peripheral wall) of each joint member 12, a circular hole 3 and an elliptical hole 4 are formed spaced apart in the axial direction of the joint member 12, with two holes 3, 3 facing each in the radial direction across the cylindrical joint member 12, and two holes 4, 4 facing each other in the radial direction across the cylindrical joint member 12.

Further, the distal end portions of the joint members 12 disposed at right angles to each other are connected by reinforcing members 16.

Also, in the present embodiment, since the distal end portions of the joint members 12 disposed at right angles to each other are connected by the rod-like reinforcing members 16, it is possible to use the reinforcing members 16 to easily reinforce the connecting portions of the structural members connected by the structural member joints 70.

FIG. 10 is a perspective view showing a structure 101 assembled by using the above-described structural member joints 1, 20, 40, 60 and a plurality of rod-like structural members 7.

In FIG. 10, description will be given with the vertical direction being marked as Z direction, the horizontal direction being marked as X direction, and the forward/backward direction being marked as Y direction.

The structure 101 is formed into a rectangular parallelepiped box shape as a whole. Structural member joints 1, 20, 40, 60 are selectively disposed at the connecting portions of the structural members 7, and a plurality of structural members 7 are connected by these structural member joints 1, 20, 40, 60.

First, description will be given to explain a structure 101A forming the lower surface side of the structure 101.

At the two corners in the front-rear direction (Y direction) on the left side of the lower surface of the structure 101, there are disposed structural member joints 1, 1 each having a joint member 2A oriented in the 2 direction (vertical direction). Between these structural member joints 1, 1, there is disposed a structural member joint 20, with its joint member 2A oriented in the 2 direction and another joint member 2C being directed toward the inside (X direction) of the structure 101. Then, end portions of a structural member 7 are respectively inserted into the joint member 2C of the one structural member joint 1 and the joint member 2B of the other structural member joint 20, followed by being fixed there. Further, the end portions of another structural member 7 are respectively inserted into the joint member 2B of the other structural member joint 1 and the joint member 2D of the structural member joint 20, followed by being fixed there.

When inserting and fixing the structural members 7 into the joint members 2, bolts (not shown) are respectively inserted into the holes 3, 4 of the joint members 2 and the holes 7*a*, 7*a* of the structural members 7, followed by being fastened using the nuts (see FIG. 1).

In the following description, since the structural members 7 are inserted into the joint members 2 and fixed there in the same manner as described above, the same description thereof is omitted.

At the two corners in the front-rear direction (Y direction) on the right side of the lower surface of the structure 101, there are disposed structural member joints 20, 20 each having a joint member 2A oriented in the Z direction (vertical direction), and having a joint member 2C oriented in the Y direction. Between these structural member joints 20, 20, there is disposed a structural member joint 40, with its joint member 2A oriented in the 2 direction and other joint members 2B, 2D being oriented in Y direction. Then, end portions of a structural member 7 are respectively inserted into the joint member 2C of one structural member joint 20 and the joint member 2B of the other structural member joint 40, followed by being fixed there. Further, the end portions of another structural member 7 are respectively inserted into the joint member 2C of the other structural member joint 20 and the joint member 2D of the structural member joint 40, followed by being fixed there.

Further, on the lower front side of the structure 101, the structural member joint 20 is arranged between the structural member joints 1 and 20, with the joint member 2A being oriented in the 2 direction and the joint members 2B, 20 being oriented in the X direction. Then, end portions of a structural member 7 are respectively inserted into the joint member 2B of the one structural member joint 1 located on one corner and the joint member 2B of the other structural member joint 20 located on the center side, followed by being fixed there. Further, the end portions of another structural member 7 are respectively inserted into the joint member 2D of the other structural member joint 20 located on the other corner and the joint member 2B of the structural member joint 20 located on the center side, followed by being fixed there.

Further, on the lower back side of the structure 101, a structural member joint 20 is arranged between the structural member joints 1 and 20, with the joint member 2A being oriented in the Z direction and the joint members 2E, 2D being oriented in the X direction. Then, end portions of a structural member 7 are respectively inserted into the joint member 2C of the one structural member joint 1 located on one corner and the joint member 2B of the other structural member joint 20 located on the center side, followed by being fixed there. Further, the end portions of another structural member 7 are respectively inserted into the joint member 2B of the other structural member joint 20 located on the other corner and the joint member 2D of the structural member joint 20 located on the center side, followed by being fixed there.

In addition, at the center of the lower surface of the structure 101, the structural member joint 40 directs its joint member 2A in the Z direction, its joint members 2B and 2D in the X direction, and its joint members 2C and 2E in the Y direction.

Then, end portions of a structural member 7 are respectively inserted into the joint member 2C of the structural member joint 40 and the joint member 2C of the structural member joint 20 located on the center of the front side, followed by being fixed there. Moreover, end portions of another structural member 7 are respectively inserted into the joint member 2E of the structural member joint 40 and the joint member 2C of the structural member joint 20 located on the center of the back side, followed by being fixed there.

Further, the end portions of another structural member 7 are respectively inserted into the joint member 2B of the structural member joint 40 and the joint member 2C of the structural member joint 20 located on the left center side, followed by being fixed there. Moreover, the end portions of another structural member 7 are respectively inserted into the joint member 2D of the structural member joint 40 and the joint member 2E of the structural member joint 40 located on the right center side, followed by being fixed there.

Next, description will be given to explain a structure 101B forming the upper surface side of the structure 101.

At the two corners in the front-rear direction (Y direction) on the left side of the upper surface of the structure 101, there are disposed structural member joints 20, 20 each having its joint members 2B, 2D oriented in the Z direction (vertical direction). Between these structural member joints 20, 20, there is disposed a structural member joint 40, with its joint members 2C, 2E being oriented in the 2 direction, its joint member 2A being directed toward the inside (X direction) of the structure 101, and other joint members 2B, 2D being oriented in the Y direction. Then, end portions of a structural member 7 are respectively inserted into the joint member 2A of one structural member joint 20 and the joint member 2D of the structural member joint 40, followed by being fixed there. Further, the end portions of another structural member are respectively inserted into the joint member 2C of the other structural member joint 20 and the joint member 2B of the structural member joint 40, followed by being fixed there.

At the two corners in the front-rear direction (Y direction) on the right side of the upper surface of the structure 101, there are disposed structural member joints 40, 40 each having its joint member 2C, 2E oriented in the Z direction (vertical direction), and its joint member 2A oriented in the Y direction. Between these structural member joints 40, 40, there is disposed a structural member joint 60, with its joint members 2A, 2F being oriented in the Z direction, its joint members 2B, 2D being directed toward the inside (X direction) of the structure 101, and other joint members 2C, 2E being oriented in the Y direction. Then, end portions of a structural member 7 are respectively inserted into the joint member 2A of one structural member joint 40 and the joint member 2C of the other structural member joint 60, followed by being fixed there. Further, the end portions of another structural member 7 are respectively inserted into the joint member 2A of another structural member joint 40 and the joint member 2E of the structural member joint 60, followed by being fixed there.

Further, on the upper front side of the structure 101, a structural member joint 40 is arranged between the structural member joints 20 and 40, with the joint members 2C, 2E being oriented in the Z direction and the joint members 2B, 2D being oriented in the X direction, and the joint member 2A being oriented in the Y direction. Then, end portions of a structural member 7 are respectively inserted into the joint member 2C of the structural member joint 20 located on the corner and the joint member 2B of the structural member joint 40 located on the center side, followed by being fixed there. Moreover, the end portions of another structural member 7 are respectively inserted into the joint member 2B of the structural member joint 40 located on the corner and the joint member 2D of the structural member joint 40 located on the center side, followed by being fixed there.

Further, on the upper back side of the structure 101, a structural member joint 40 is arranged between the structural member joints 20 and 40, with the joint members 2C, 2E being oriented in the 2 direction and the joint members 2B, 2D being oriented in the X direction, and the joint member 2A being oriented in the Y direction. Then, end portions of a structural member 7 are respectively inserted into the joint member 2A of the structural member joint 20 located on the corner and the joint member 2D of the structural member joint 40 located on the center side, followed by being fixed there. Moreover, the end portions of another structural member 7 are respectively inserted into the joint member 2D of the structural member joint 40 located on the corner and the joint member 2B of the structural member joint 40 located on the center side, followed by being fixed there.

In addition, at the center of the upper surface of the structure 101, the structural member joint 60 directs its joint members 2A, 2F in the 2 direction, its joint members 2E and 2D in the X direction, and its joint members 2C and 2E in the Y direction.

Then, end portions of a structural member 7 are respectively inserted into the joint member 2C of the structural member joint 60 and the joint member 2A of the structural member joint 40 located on the center of the front side, followed by being fixed there. Moreover, end portions of another structural member 7 are respectively inserted into the joint member 2E of the structural member joint 60 and the joint member 2A of the structural member joint 40 located on the center of the back side, followed by being fixed there.

Further, the end portions of structural member 7 are respectively inserted into the joint member 2B of the structural member joint 60 and the joint member 2A of the structural member joint 40 located on the center of the left side, followed by being fixed there. Moreover, the end portions of another structural member 7 are respectively inserted into the joint member 2D of the structural member joint 60 and the joint member 2B of the structural member joint 60 located on the center of the right side, followed by being fixed there.

The structure 101A on the lower surface side and the structure 101B on the upper surface side, configured as described above, are connected by a plurality of structural members 7 arranged one above the other.

Namely, on the left side of the structures 101A and 101B, the end portions of the structural members 7 are respectively inserted into the joint members 2A, 2A of the structural member joints 2, 1 and the joint member 2A of the structural member joint 20, all arranged on the left side of the structure 101A, followed by being fixed there. Meanwhile, the end portions of the structural members 7 are also respectively inserted into the joint members 2D, 2D of the structural member joints 20, 20 and the joint member 2E of the structural member joint 40, all disposed on the left side of the structure 101B, followed by being fixed there.

Namely, on the right side of the structures 101A and 101B, the end portions of the structural members 7 are respectively inserted into the joint members 2A, 2A of the structural member joints 20, 20 and the joint member 2A of the structural member joints 40,40, all arranged on the right side of the structure 101A, followed by being fixed there. Meanwhile, the end portions of the structural members 7 are also respectively inserted into the joint members 2E, 2E of the structural member joint 40, 40 and the joint member 2F of the structural member joint 60, all disposed on the right side of the structure 1016, followed by being fixed there.

Furthermore, on the center side (the center side in the X direction) of the structures 101A, 101B, the end portions of a structural member 7 are respectively inserted into the joint members 2A, 2A of the structural member joints 20, 20 (arranged respectively on the front side and back side of the structure 101A) and the joint member 2A of the structural member joint 40 (arranged on the center side of the structure 101A), followed by being fixed there. Meanwhile, the end portions of another structural member 7 are respectively inserted into the joint members 2E, 2E of the structural member joints 40, 40 (arranged respectively on the front side and back side of the structure 101B) and the joint member 2F of the structural member joint 60 (arranged on the center side of the structure 101B), followed by being fixed there.

In this way, the structure 101A and the structure 101 B are connected by a plurality of structural members 7 arranged one above the other, thus assembling the structure 101.

In addition, in such a structure 101, at least some of the structural member joints 20, 40, and 60 of the structural member joints 20, 40, and 60 arranged on the outer side have joint members 2B-2D not connected with the structural members 7.

According to the present embodiment, the structural member joints 1, 20, 40, 60 are selectively disposed at the connecting portions of the structural members 7, and a plurality of structural members 7 are connected by virtue of these structural member joints 1, 20, 40, 60.

In this way, the distal end portions of the joint members 2 (2A-2F) disposed at right angles to each other for the structural member joints 1, 20, 40, and 60 arranged at the connecting portions of the structural members 7 are connected to each other by rod-like members 6. Therefore, it is possible to use the reinforcing members 6 to reinforce the connecting portions of the structural members 7 connected by the structural member joints 1, 20, 40, 60.

The structure 101B constituting the upper surface of the structure 101 has structural member joints 20, 40, and 60. These structural member joints 20, 40, and 60 are provided with joint members 2B, 2C, 2A each protruding upwardly, so that it is possible to superimpose and connect the same structure as the structure 101B above the structure 101. In this way, it is possible to upwardly expand the structure 101.

Further, the structure constituting the right side surface of the structure 101 has the structural member joints 20, 40, 60, and these structural member joints 20, 40, 60 have joint members 2B, 2C, 2D protruding towards the right in the paper. Therefore, it is possible to connect the same structure as the structure constituting the right side of the structure 101, on the right side of this structure. In this way, it is possible to expand the structure 101 in the rightward direction.

Furthermore, by suitably and selectively arranging the structural member joints 1, 20, 40, 60, the structure 101 can also be expanded in the front-rear direction, rightward direction and downward direction.

In the present embodiment, the structure 101 with its skeleton having a square cross-section is assembled by using the structural member joints 1, 20, 40, 60 and the structural members 7. On the other hand, using structural member joints 10, 30, 50, 70 and cylindrical members 8, it is also possible to assemble a structure 102 having a skeleton structure formed by the cylindrical members, as shown in FIG. 11.

However, since the arrangement and orientation of the structural member joints 10, 30, 50, 70 constituting the structure 102 are the same as those of the structural member joints 1, 20, 40, 60 constituting the structure 101, the explanations thereof are hereby omitted.

EXPLANATIONS OF REFERENCE NUMERALS

1, 10, 20, 30, 40, 50, 60, 70: structural member joints
2, 2A, 2B, 2C, 2D, 2E, 2F: joint members
6, 16: reinforcing members
7, 8: structural members
100, 101, 102: structures

The invention claimed is:

1. A structural member joint for connecting elongate structural members, the structural member joint comprising:

three or more tubular joint members configured to receive end portions of the structural members, and a fixing member, wherein:

proximal end portions of the three or more tubular joint members are connected to the fixing member, each tubular joint member being disposed at a right angle to at least one other of the tubular joint members; and each tubular joint member is connected to at least two other of the tubular joint members by reinforcing members.

2. The structural member joint for connecting elongate structural members according to claim 1, wherein:

the three or more tubular joint members comprise four tubular joint members; and three of the four tubular joint members are disposed into T-shaped formation, and the remaining one is disposed at right angle with other three tubular joint members.

3. A structure comprising:

a plurality of elongate structural members, and a plurality of structural member joints according to claim 2 connecting the structural members.

4. The structure according to claim 3, wherein at least one of the structural member joints disposed at an outside of the structure has an empty joint member, among the tubular joint members, to which no structural member is connected.

5. The structural member joint for connecting elongate structural members according to claim 1, wherein:

the three or more tubular joint members comprise five tubular joint members; and four of the five tubular joint members are disposed into cross-shaped formation, and the remaining one is disposed at right angle with other four tubular joint members.

6. A structure comprising:

a plurality of elongate structural members, and a plurality of structural member joints according to claim 5 connecting the structural members.

7. The structure according to claim 6, wherein at least one of the structural member joints disposed at an outside of the structure has an empty joint member, among the tubular joint members, to which no structural member is connected.

8. The structural member joint for connecting elongate structural members according to claim 1, wherein:

the three or more tubular joint members comprise six tubular joint members; and four of the six joint members are disposed into cross-shaped formation, and the remaining two are disposed into one straight line and disposed at right angle with other four tubular joint members.

9. A structure comprising:

a plurality of elongate structural members, and a plurality of structural member joints according to claim 8 connecting the structural members.

10. The structure according to claim 9, wherein at least one of the structural member joints disposed at an outside of the structure has an empty joint member, among the tubular joint members, to which no structural member is connected.

11. A structure comprising:

a plurality of elongate structural members, and a plurality of structural member joints according to claim 1 connecting the structural members.

12. The structure according to claim 11, wherein at least one of the structural member joints disposed at an outside of the structure has an empty joint member, among the tubular joint members, to which no structural member is connected.

13. The structural member joint according to claim 1, wherein a hole is formed in the fixing member at a position of the fixing member where no proximal end portion of any of the tubular joint members is joined to the fixing member.

14. The structural member joint according to claim 13, wherein the fixing member has a plurality of surfaces, each surface being perpendicular to at least one other of the surfaces, the surfaces being greater in number than the three or more tubular joint members;

the proximal end portions of the other ones of the tubular joint members are each joined to a respective one of the surfaces;

a hole is formed in one of the surfaces to which none of the tubular joint members is joined.

15. The structural member joint according to claim 1, wherein front end portions of the tubular joint members disposed at right angles to each other are connected by reinforcing members arranged into an equilateral triangle.

16. A structural member joint for connecting elongate structural members, the structural member joint comprising:

three or more tubular joint members configured to receive end portions of the structural members, wherein:

the three or more tubular joint members are connected to each other at proximal end portions thereof and disposed at right angles to each other;

one of the tubular joint members is longer than other ones of the tubular joint members;

the proximal end portion of the one of the tubular joint members has a plurality of surfaces, each surface being perpendicular to at least one other of the surfaces, the surfaces being greater in number than the three or more tubular joint members;

the proximal end portions of the other ones of the tubular joint members are each joined to a respective one of the surfaces;

a hole is formed in one of the surfaces to which none of the tubular joint members is joined; and each tubular joint member is connected to at least two other of the tubular joint members by reinforcing members.

17. The structural member joint according to claim 16, wherein front end portions of the tubular joint members disposed at right angles to each other are connected by reinforcing members arranged into an equilateral triangle.

18. A structure comprising:

a plurality of elongate structural members, and a plurality of structural member joints according to claim 16 connecting the structural members.

19. The structure according to claim 18, wherein at least one of the structural member joints disposed at an outside of the structure has an empty joint member, among the tubular joint members, to which no structural member is connected.

20. The structural member joint according to claim 16, wherein a second hole is formed in another of the surfaces to which none of the tubular joint members is joined, enabling a nut to be inserted through the second hole to attach to a bolt inserted through the hole.

* * * * *